US006569316B2

(12) United States Patent
Winter

(10) Patent No.: US 6,569,316 B2
(45) **Date of Patent: *May 27, 2003**

(54) CYCLE OIL CONVERSION PROCESS INCORPORATING SHAPE-SELECTIVE ZEOLITE CATALYSTS

(75) Inventor: William E. Winter, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 8 days.

This patent is subject to a terminal disclaimer.

(21) Appl. No.: 09/811,170

(22) Filed: Mar. 16, 2001

(65) Prior Publication Data

US 2002/0043477 A1 Apr. 18, 2002

Related U.S. Application Data

(60) Provisional application No. 60/197,464, filed on Apr. 17, 2000, and provisional application No. 60/206,410, filed on May 23, 2000.

(51) Int. Cl.[7] ..... C10G 51/02
(52) U.S. Cl. ..... 208/77; 208/72; 208/74
(58) Field of Search ..... 208/72, 74, 77

(56) References Cited

U.S. PATENT DOCUMENTS

| | | | | | |
|---|---|---|---|---|---|
| 2,890,164 | A | | 6/1959 | Woertz | 208/74 |
| 3,065,166 | A | | 11/1962 | Henning | 208/67 |
| 3,479,279 | A | | 11/1969 | Pohlenz | 208/56 |
| 3,489,673 | A | | 1/1970 | Stine et al. | 208/73 |
| 3,533,936 | A | | 10/1970 | Weisz | 208/56 |
| 3,536,609 | A | | 10/1970 | Stine et al. | 208/72 |
| 3,617,497 | A | | 11/1971 | Bryson et al. | 208/80 |
| 3,630,886 | A | | 12/1971 | Deed et al. | 208/96 |
| 3,692,667 | A | | 9/1972 | McKinney et al. | 208/120 |
| 3,758,403 | A | * | 9/1973 | Rosinski et al. | 208/111.01 |
| 3,761,391 | A | | 9/1973 | Conner | 208/76 |
| 3,803,024 | A | | 4/1974 | Haunschild | 208/76 |
| 3,886,060 | A | | 5/1975 | Owen | 208/120 |
| 3,893,905 | A | * | 7/1975 | Fenske et al. | 203/87 |
| 3,894,933 | A | | 7/1975 | Owen et al. | 208/77 |
| 3,928,172 | A | | 12/1975 | Davis, Jr. et al. | 208/77 |
| 4,051,013 | A | | 9/1977 | Strother | 208/78 |
| 4,239,654 | A | | 12/1980 | Gladrow et al. | 252/455 Z |
| 4,267,072 | A | | 5/1981 | Vasalos | 252/455 |
| 4,388,175 | A | | 6/1983 | Lionetti et al. | 208/74 |
| 4,490,241 | A | | 12/1984 | Chou | 208/75 |
| 4,585,545 | A | | 4/1986 | Yancey, Jr. et al. | 208/74 |
| 4,750,988 | A | | 6/1988 | Mitchell et al. | 208/118 |
| 4,775,461 | A | | 10/1988 | Harris et al. | 208/120 |
| 4,794,095 | A | | 12/1988 | Walker et al. | 502/64 |
| 4,846,960 | A | | 7/1989 | Walker et al. | 208/119 |
| 4,892,643 | A | | 1/1990 | Herbst et al. | 208/70 |
| 4,968,405 | A | | 11/1990 | Wachter | 208/120 |
| 5,043,522 | A | | 8/1991 | Leyshon et al. | 585/651 |
| 5,098,554 | A | | 3/1992 | Krishna et al. | 208/113 |
| 5,139,648 | A | | 8/1992 | Lambert | 208/111 |
| 5,152,883 | A | | 10/1992 | Melin et al. | 208/61 |
| 5,176,815 | A | | 1/1993 | Lomas | 208/78 |
| 5,243,121 | A | | 9/1993 | Madon et al. | 585/649 |
| 5,278,114 | A | | 1/1994 | Wielers et al. | 502/67 |
| 5,318,689 | A | | 6/1994 | Hsing et al. | 208/70 |
| 5,318,692 | A | * | 6/1994 | Eberly et al. | 208/113 |
| 5,389,232 | A | | 2/1995 | Adewuyi et al. | 208/120 |
| 5,582,711 | A | * | 12/1996 | Ellis et al. | 208/100 |
| 5,770,043 | A | * | 6/1998 | Ellis et al. | 208/100 |
| 5,770,044 | A | * | 6/1998 | Ellis et al. | 208/100 |
| 5,846,403 | A | | 12/1998 | Swan et al. | 208/113 |
| 5,944,982 | A | | 8/1999 | Lomas | 208/164 |
| 5,997,728 | A | * | 12/1999 | Adewuyi et al. | 208/113 |
| 6,106,697 | A | * | 8/2000 | Swan et al. | 208/67 |
| 6,123,830 | A | * | 9/2000 | Gupta et al. | 208/57 |
| 6,258,257 | B1 | * | 7/2001 | Swan et al. | 208/72 |

FOREIGN PATENT DOCUMENTS

| | | |
|---|---|---|
| CA | 852713 | 9/1970 |
| CA | 863912 | 2/1971 |
| CA | 935110 | 10/1973 |
| DE | 248516 | 8/1987 |
| DE | 4114874 | 11/1991 |
| EP | 0101553 | 2/1984 |
| EP | 0369536 | 5/1990 |
| EP | 0391528 | 10/1990 |
| EP | 0825243 | 2/1998 |
| EP | 0825244 | 2/1998 |
| WO | WO90/15121 | 12/1990 |

* cited by examiner

*Primary Examiner*—Walter D. Griffin
(74) *Attorney, Agent, or Firm*—Michael A. Cromwell; Erika Singleton Wilson

(57) ABSTRACT

The invention relates to a process for converting cycle oils produced in catalytic cracking reactions into light olefin, preferably propylene. More particularly, the invention relates to a process for hydroprocessing a catalytically cracked light cycle oil, and then re-cracking in a second FCC reactor.

21 Claims, 3 Drawing Sheets

CYCLE OIL CONVERSION PROCESS INCORPORATING SHAPE-SELECTIVE ZEOLITE CATALYSTS

CROSS-REFERENCE TO RELATED APPLICATIONS

This patent application claims benefit of U.S. provisional patent applications Nos. 60/197,464 filed Apr. 17, 2000 and 60/206,410 filed May 23, 2000.

BACKGROUND OF THE INVENTION

The invention relates to a process for converting cycle oils produced in catalytic cracking reactions into olefinic naphthas. More particularly, the invention relates to an out-board catalytic cracking process for converting a catalytically cracked light cycle oil (also referred to herein as light cat cycle oil or LCCO) into light olefins ($C_2$–$C_5$) and catalysts used in such processes.

Cycle oils such as LCCO produced in fluidized catalytic cracking (FCC) reactions contain two-ring aromatic species such as naphthalene. The need for blendstocks for forming low emissions fuels has created an increased demand for FCC products that contain a diminished concentration of multi-ring aromatics. There is also an increased demand for FCC products containing light olefins that may be separated for use in alkylation, oligomerization, polymerization, and MTBE and ETBE synthesis processes. There is a particular need for low emissions, high-octane FCC products having an increased concentration of $C_2$–$C_4$ olefins and reduced concentration of multi-ring aromatics and olefins of higher molecular weight.

Hydroprocessing a cycle oil and re-cracking hydroprocessed cycle oil results in conversion of the cycle oil to a motor gasoline blend-stock. In some conventional processes, the hydroprocessed cycle oil is recycled to the FCC unit from which it was derived. In other conventional processes the hydroprocessed cycle oil is re-cracked in an additional catalytic cracking unit, sometimes referred to as an outboard catalytic cracker.

Some conventional hydroprocessing operations hydroprocess cycle oil such as LCCO to only partially saturate bicyclic hydrocarbons such as naphthalene to produce tetrahydronaphthalene. Hydroprocessing and subsequent LCCO re-cracking may occur in the primary reactor vessel. Hydroprocessed LCCO may also be injected into the FCC feed riser at a point downstream of feed injection to provide for feed quenching.

Unfortunately, such re-cracking of hydroprocessed LCCO results in undesirable hydrogen transfer reactions that convert unsaturated species such as tetrahydronaphthalene into aromatics such as naphthalene and decreases the olefin yield from the outboard catalytic cracker.

There remains a need, therefore, for new processes for light olefins produced from hydroprocessed cycle oils such as LCCO.

SUMMARY OF THE INVENTION

Accordingly, one embodiment of the present invention comprises a fluid catalytic cracking process that comprises the steps of: (a) contacting a FCC feed with a catalytic cracking catalyst in a first catalytic cracking stage under catalytic cracking conditions to produce cracked products; (b) separating at least a cycle oil fraction containing aromatics from the cracked products; (c) hydrogenating at least a fraction of the aromatics in the cycle oil fraction in the presence of a hydrogenating catalyst under hydrogenation conditions to form a hydrogenated cycle oil; and, (d) contacting the hydrogenated cycle oil with a catalytic cracking catalyst under catalytic cracking conditions in a second fluid catalytic cracking stage to form a second cracked product, wherein the second fluid catalytic cracking stage is separate from the first second fluid catalytic cracking stage and wherein the catalyst of the second fluid catalytic cracking stage comprises between about 50 and about 95 wt. % shape-selective zeolite, and between about 5 and about 50 wt. % of a large-pore zeolite having a pore diameter greater than or equal to about 0.7 nm.

Another embodiment of the present invention comprises a process for catalytically cracking a cycle oil to selectively increase the yield of light olefins comprising the steps of: (a) contacting a FCC feed with a catalytic cracking catalyst under catalytic cracking conditions in a first FCC reactor to form a first cracked product comprising a cycle oil fraction comprising aromatic species; (b) separating the first cracked product from the catalyst of the first FCC reactor; (c) stripping the catalyst of the first FCC reactor; (d) contacting the catalyst of the first FCC reactor with a gas comprising oxygen; (e) passing the catalyst of the first FCC reactor back to the first FCC reactor; (f) separating at least a portion of the cycle oil fraction from the first cracked product; (g) hydrogenating a substantial portion of the aromatic species in the cycle oil in the presence of a hydrogenation catalyst under hydroprocessing conditions to form a substantially hydrogenated cycle oil, wherein the hydrogenation catalyst comprises at least one Group VIII metal and at least one Group VI metal on at least one refractory support, wherein the Group VI metal is selected from the group consisting of Pt and Pd, wherein the weight of the aromatic species in the hydrogenated cycle oil is less than about 1% of the total weight of the hydrogenated cycle oil; (h) contacting the hydrogenated cycle oil with a catalytic cracking catalyst under catalytic cracking conditions in a separate second FCC reactor to form a second cracked product, wherein the catalyst used in the second FCC reactor comprises wherein the catalyst used in the second FCC reactor comprises between about 80 and about 95 wt. % ZSM-5, and between about 5 and about 20 wt. % of a large-pore zeolite having a pore diameter greater than or equal to about 0.7 nm and a unit cell size less than 24.27 Å; (i) separating the second cracked product from the catalyst of the second FCC reactor; (j) stripping the catalyst of the second FCC reactor; (k) contacting the catalyst of the second FCC reactor with a gas comprising oxygen; and, (l) passing the catalyst of the second FCC reactor to said second FCC reactor back to the second FCC reactor.

DETAILED DESCRIPTION OF THE INVENTION

Figure 1:
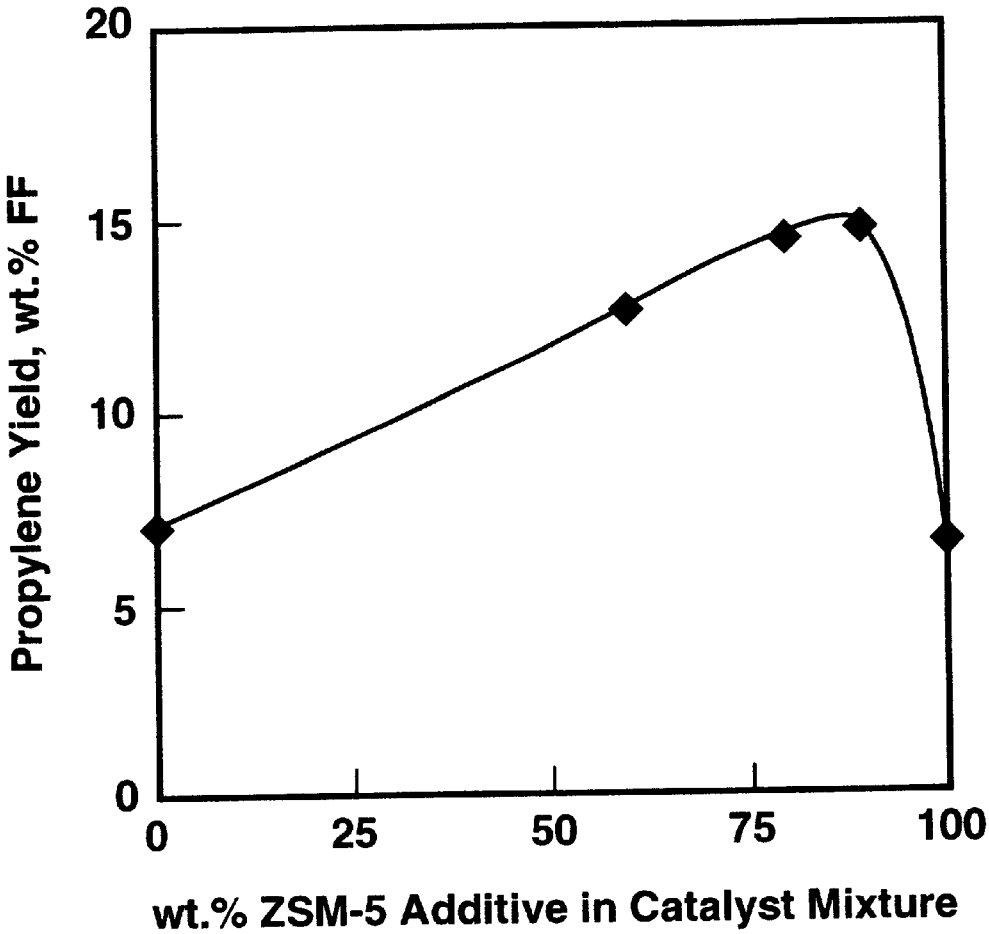
FIG. 1 illustrates the variation of propylene yield relative to the weight percentage of an additive catalyst containing ZSM-5.

The embodiments of the present invention are based on the discovery that catalytically cracking a substantially saturated cycle oil, such as LCCO, in a FCC riser reactor results in beneficial conversion of the cycle oil into light olefins such as propylene. Light olefin production increases when cracking occurs in the absence of hydrogen receptor species that may be found in conventional catalytic cracking feeds such as vacuum gas oil (VGO) and other heavy hydrocarbon and hydrocarbonaceous feeds. The cycle oil is hydroprocessed to saturate a substantial portion of the aromatic species. The hydrogenated cycle oil is injected into a second FCC riser reactor that is physically separated from the primary FCC riser reactor used to convert VGO and other heavy FCC feeds.

While not wishing to be bound by any theory, applicants believe that cracking the hydrogenated cycle oil in a second FCC riser reactor suppresses undesirable hydrogen transfer reactions that would otherwise occur if the cycle oil were re-cracked in the primary FCC riser reactor. Re-cracking in a second FCC reactor under cycle oil cracking conditions (i.e., conditions that exclude gas oils and residual oils from the reaction zone) substantially eliminates hydrogen transfer reactions between hydrogen donor species present in the cycle oil and hydrogen receptor species present in the VGO or residual oil because the concentration of hydrogen receptors species is decreased.

Suitable FCC feeds for the catalytic cracking process in the primary FCC riser reactor include hydrocarbonaceous oils boiling in the range of about 430° F. to about 1050° F. (480–565° C.), such as gas oil, heavy hydrocarbon oils comprising materials boiling above 1050° F. (565° C.); heavy and reduced petroleum crude oil; petroleum atmospheric distillation bottoms; petroleum vacuum distillation bottoms; pitch, asphalt, bitumen, other heavy hydrocarbon residues; tar sand oils; shale oil; liquid products derived from coal liquefaction processes; and mixtures thereof.

Cycle oil formation occurs in one or more conventional FCC process units under conventional FCC conditions in the presence of conventional FCC catalyst(s). Each FCC unit comprises a riser reactor having a reaction zone, a stripping zone, a catalyst regeneration zone, and at least one fractionation zone. The FCC feed passes to the primary FCC riser reactor where it is injected into the reaction zone so that the FCC feed contacts a flowing source of hot, regenerated catalyst.

The FCC feed is cracked under conventional FCC conditions in the presence of a first catalytic cracking catalyst. The process conditions in the primary FCC reactor reaction zone include: (i) temperatures from about 500° C. to about 650° C., preferably from about 525° C. to 600° C.; (ii) hydrocarbon partial pressures from about 10 to 40 psia (70–280 kPa), preferably from about 20 to 35 psia (140–245 kPa); and, (iii) a catalyst to feed (wt/wt) ratio from about 3:1 to 12:1, preferably from about 4:1 to 10:1, where the catalyst weight is the total weight of the catalyst composite. Though not required, steam may be concurrently introduced with the feed into the reaction zone. The steam may comprise up to about 10 wt. %, preferably between about 2 and about 3 wt. % of the feed. Preferably, the FCC feed residence time in the reaction zone is less than about 10 seconds, more preferably from about 1 to 10 seconds.

The catalytic cracking catalyst of the first FCC stage comprises any conventional FCC catalyst. Suitable catalysts include: (a) amorphous solid acids, such as alumina, silica-alumina, silica-magnesia, silica-zirconia, silica-thoria, silica-beryllia, silica-titania, and the like; and (b) zeolite catalysts containing faujasite. Silica-alumina materials suitable for use in the present invention are amorphous materials containing about 10 to 40 wt. % alumina and to which other promoters may or may not be added.

Zeolitic materials suitable for use in the practice of the present invention are zeolites which are iso-structural to zeolite Y. These include the ion-exchanged forms such as the rare-earth hydrogen and ultra stable (USY) form. The particle size of the zeolite may range from about 0.1 to 10 microns, preferably from about 0.3 to 3 microns. The zeolite will be mixed with a suitable porous matrix material when used as a catalyst for fluid catalytic cracking. The catalyst may contain at least one crystalline aluminosilicate, also referred to herein as a large-pore zeolite, having an average pore diameter greater than about 0.7 nanometers (nm). The pore diameter, also sometimes referred to as effective pore diameter, is measured using standard adsorption techniques and hydrocarbons of known minimum kinetic diameters. See Breck, *Zeolite Molecular Sieves,* 1974 and Anderson et al., J. Catalysis 58, 114 (1979), both of which are incorporated herein by reference. Zeolites useful in the second catalytic cracking catalyst are described in the "Atlas of Zeolite Structure Types", eds. W. H. Meier and D. H. Olson, Butterworth-Heineman, Third Edition, 1992, which is hereby incorporated by reference.

The large-pore zeolites may include "crystalline admixtures" which are thought to be the result of faults occurring within the crystal or crystalline area during the synthesis of the zeolites. The crystalline admixtures are themselves medium pore size, shape selective, zeolites and are not to be confused with physical admixtures of zeolites in which distinct crystals of crystallites of different zeolites are physically present in the same catalyst composite or hydrothermal reaction mixtures.

The catalytic cracking catalyst particles may contain metals such as platinum, promoter species such as phosphorous-containing species, clay filler, and species for imparting additional catalytic functionality, such as bottoms cracking and metals passivation. Such an additional catalytic functionality may be provided, for example, by aluminum-containing species. In addition, individual catalyst particles may contain large-pore zeolite, amorphous species, other components described herein, and mixtures thereof.

Non-limiting porous matrix materials that may be used include alumina, silica-alumina, silica-magnesia, silica-zirconia, silica-thoria, silica-beryllia, silica-titania, and ternary compositions, such as silica-alumina-thoria, silica-alumina-zirconia, magnesia and silica-magnesia-zirconia. The matrix may also be in the form of a cogel. The matrix itself may possess acidic catalytic properties and may be an amorphous material. The inorganic oxide matrix component binds the particle components together so that the catalyst particle product is hard enough to survive inter-particle and reactor wall collisions. The inorganic oxide matrix may be made according to conventional processes from an inorganic oxide sol or gel that is dried to bind the catalyst particle components together. Preferably, the inorganic oxide matrix is not catalytically active and comprises oxides of silicon and aluminum. Preferably, separate alumina phases may be incorporated into the inorganic oxide matrix. Species of aluminum oxyhydroxides-g-alumina, boehmite, diaspore, and transitional aluminas such as α-alumina, β-alumina, γ-alumina, δ-alumina, ϵ-alumina, κ-alumina, and ρ-alumina can be employed. The alumina species may be an aluminum trihydroxide such as gibbsite, bayerite, nordstrandite, or doyelite. The matrix material may also contain phosphorous or aluminum phosphate.

Suitable amounts of zeolite component in the total catalyst will generally range from about 1 to about 60 wt. %, preferably from about 1 to about 40 wt. %, and more preferably from about 5 to about 40 wt. %, based on the total weight of the catalyst. Generally, the particle size of the total catalyst will range from about 10 to 300 microns in diameter, with an average particle diameter of about 60 microns. The surface area of the matrix material will be less than about 350 $m^2/g$, preferably 50 to 200 $m^2/g$, more preferably from about 50 to 100 $m^2/g$. While the surface area of the final catalysts will be dependent on such things as type and amount of zeolite material used, it will usually be less than about 500 $m^2/g$, preferably from about 50 to 300 $m^2/g$, more preferably from about 50 to 250 $m^2/g$, and most preferably from about 100 to 250 $m^2/g$.

The cracking reactions deposits coke on the catalyst, thereby deactivating the catalyst. The cracked products are separated from the coked catalyst and at least a portion of the cracked products are conducted to a fractionator. The fractionator separates at least a cycle oil fraction, preferably a cycle oil fraction containing aromatic species including single and double ring aromatics, from the cracked products. The coked catalyst flows through the stripping zone where volatiles (strippable hydrocarbons) are stripped from the catalyst particles with a stripping material such as steam. Stripping preferably occurs under low severity conditions to retain a greater fraction of adsorbed hydrocarbons for heat balance. The stripped catalyst is then conducted to the regeneration zone where it is regenerated by burning coke on the catalyst in the presence of an oxygen containing gas, preferably air. Decoking restores catalyst activity and simultaneously heats the catalyst to about 650° C. to 750° C. The hot catalyst is then recycled to the primary FCC riser reactor. Flue gas formed by burning coke in the regenerator may be treated for removal of particulates and for conversion of carbon monoxide.

At least a portion of the cycle oil is separated from the cracked product and then hydroprocessed to form a hydrogenated cycle oil wherein a significant concentration of the aromatic and unsaturated species in the cycle oil are saturated. The terms hydroprocessing and hydrogenation are used broadly herein and include for example hydrogenation of aromatic species to substantial or complete saturation, hydrotreating, and hydrofining.

The cycle oil hydrogenation may occur in a hydroprocessing reactor under hydroprocessing conditions in the presence of an effective amount of a hydroprocessing or hydrogenation catalyst. As is known by those of skill in the art, the degree of hydroprocessing can be controlled through proper selection of catalyst and by optimizing operation conditions. Preferably, the hydroprocessing saturates a significant amount of the aromatic species, e.g., naphthalene and derivatives thereof ("naphthalenes") and tetrahydronaphthalene and derivatives thereof ("tetrahydronaphthalenes") to decahydronaphthalene and derivatives thereof ("decahydronaphthelenes"). Objectionable species can also be removed by the hydroprocessing reactions. These species include non-hydrocarbyl species that may contain sulfur, nitrogen, oxygen, halides, and certain metals.

Hydroprocessing may be performed in one or more stages consistent with the objective of maximizing conversion of multi-ring aromatics species (e.g., naphthalenes) to the corresponding fully saturated species (e.g., decahydronaphthalene). For a single-stage operation, the reaction occurs at a temperature ranging from about 200° C. to about 455° C., more preferably from about 250° C. to about 400° C. The reaction pressure preferably ranges from about 1000 to about 3000 psig, more preferably from about 1200 to about 2500 psig, and still more preferably from about 1300 to about 2000 psig. The hourly space velocity preferably ranges from about 0.1 to 6 V/V/Hr, more preferably from about 0.5 to about 2 V/V/Hr, and still more preferably from about 0.8 to about 2 V/V/Hr, where V/V/Hr is defined as the volume of oil feed per hour per volume of catalyst. The hydrogen-containing gas is preferably added to establish a hydrogen charge rate ranging from about 1,000 to about 15,000 standard cubic feet per barrel (SCF/B), more preferably from about 5,000 to about 10,000 SCF/B. Actual conditions employed will depend on factors such as feed quality and catalyst but should be consistent with the objective of maximizing conversion of multi-ring aromatic species to saturation to form a substantial concentration of decahydronaphthalenes.

In a two-stage operation, the cycle oil is first hydroprocessed to remove substantial amounts of sulfur and nitrogen, and convert bicyclic aromatics such as naphthalenes to partially saturated species such as tetrahydronaphthalenes, preferably to completely saturated species such as decahydronaphthalenes. The first stage is operated under similar conditions as described for a single stage operation. The second-stage hydrogenation reaction occurs at a temperature ranging from about 100° C. to about 455° C., preferably from about 100° C. to about 450° C., and more preferably from about 200° C. to about 400° C. The reaction pressure ranges from about 100 to about 3000 psig, preferably from about 450 to about 2000 psig, and more preferably from about 1300 psig to about 2000 psig. The hourly space velocity preferably ranges from about 0.1 to 6 V/V/Hr, preferably about 0.8 to about 2 V/V/Hr. The hydrogen-containing gas is added to establish a hydrogen charge rate ranging from about 500 to about 15,000 standard cubic feet per barrel (SCF/B), preferably from about 500 to about 10,000 SCF/B. Actual conditions employed will depend on factors such as feed quality and catalyst but should be consistent with the objective of maximizing the conversion of multi-ring aromatics to decahydronaphthalenes in the hydrogenated cycle oil before it is introduced into the second FCC reactor. In a two-stage hydroprocessor, the Group VIII noble metal catalyst are preferred to complete the saturation of the aromatic species.

Hydroprocessing conditions can be maintained using any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. In countercurrent-flow reactors, the liquid phase passes down through a fixed bed of catalyst against upward-moving treat gas. Countercurrent-flow reactors obtain higher reaction rates and alleviate aromatic hydrogenation equilibrium limitations inherent in co-current flow trickle bed reactors.

Moving bed reactors may be employed to increase metal and particulate tolerance in the hydroprocessor feed stream. Moving bed reactors generally include reactors wherein a captive bed of catalyst particles is contacted by upward-flowing liquid and treat gas. The catalyst bed may be slightly expanded by the upward flow or substantially expanded or fluidized by increasing flow rate via liquid recirculation (expanded bed or ebullating bed), using smaller size catalyst particles that are more easily fluidized (slurry bed), or both. Moving bed reactors utilizing downward-flowing liquid and gas may also be used because they enable on-stream catalyst replacement. In any case, catalyst can be removed from a moving bed reactor during onstream operation, enabling economic application when high levels of metals in the hydroprocessor feed would otherwise cause short run lengths in the alternative fixed bed designs.

Expanded or slurry bed reactors with upward-flowing liquid and gas phases enable economic operation with hydroprocessor feedstocks containing significant levels of particulate solids, by permitting long run lengths without risking shutdown from fouling. Such a reactor is especially beneficial in cases where the hydroprocessor feedstocks include solids greater than about 25 microns and where the hydroprocessor feedstocks contain contaminants that increase the propensity for accumulating foulants such as olefinic, diolefinic, or oxygenated species.

The catalyst used in the hydroprocessing stages can be any hydroprocessing catalyst(s) suitable for aromatic saturation, desulfurization, denitrogenation or any combination thereof. Suitable catalysts used to completely hydrogenate the cycle oil include monofunctional and bifunctional, monometallic and multimetallic noble metal-containing catalysts. Preferably, the catalyst comprises at least one Group VIII metal and a Group VI metal on an inorganic refractory support. Any suitable inorganic oxide support material may be used for the hydroprocessing catalyst of the present invention. Preferred are alumina and silica-alumina, including crystalline alumino-silicate such as zeolite. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 Å, preferably 70–150 Å, and a surface area from 50–450 $m^2/g$.

The Group VIII and Group VI compounds are well known to those of ordinary skill in the art and are well defined in the Periodic Table of the Elements. The Group VIII metal may be present in an amount ranging from 2–20 wt. %, preferably 4–12 wt. % and may include Co, Ni, and Fe. The Group VI metals may be W, Mo, or Cr, with Mo preferred. The Group VI metal may be present in an amount ranging from 5–50 wt. %, preferably from 20–30 wt. %. The hydroprocessing catalyst preferably includes a Group VIII noble metal present in an amount ranging from 0–10 wt. %, preferably 0.3–3.0 wt. %. The Group VIII noble metal may include, but is not limited to, Pt, Ir, or Pd, preferably Pt or Pd, to which is generally attributed the hydrogenation function.

One or more promoter metals selected from metals of Groups IIIA, IVA, IB, VIB, and VIIB of the Periodic Table of the Elements may also be present. The promoter metal, can be present in the form of an oxide, sulfide, or in the elemental state. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson. All metals weight percents for the hydroprocessing catalyst are given on support. The term "on support" means that the percents are based on the weight of the support. For example, if a support weighs 100 g, then 20 wt. % Group VIII metal means that 20 g of the Group VIII metal is on the support.

Cycle oil hydroprocessing occurs under conditions that substantially saturate the aromatic species, i.e., converting species such as naphthalene and alkyl-substituted derivatives thereof (naphthalenes) and tetrahydronaphthalene and alkyl-substituted derivatives thereof (tetrahydronaphthalenes) to decahydronaphthalene and derivatives thereof (decahydronaphthalenes). While not wishing to be bound by any theory or model, applicants believe that the hydroprocessing conditions result in a hydrogenated cycle oil that has a greater propensity for cracking to light olefins ($C_2$–$C_4$) than cycle oils hydroprocessed in accordance with the conventional processes that aim to produce significant amounts of tetrahydronaphthalenes.

The hydroprocessing is conducted so that decahydronaphthalenes are the most abundant 2-ring species in the hydrogenated cycle oil. Decahydronaphthalenes are preferably the most abundant saturated species in the hydrogenated cycle oil.

Preferably, the total aromatic species content in the hydrogenated cycle oil ranges from about 0 to about 5 wt. %, with a total 2-ring or larger aromatic species content ranges from about 0 to about 1 wt. %, preferably 0–0.1 wt. %, more preferably 0–0.05 wt. %, most preferably 0–0.01 wt. % based upon the total weight of the hydrogenated cycle oil. Still more preferably, the total aromatic species content in the hydrogenated cycle oil ranges is less than 5 wt. %, more preferably less than about 1 wt. %, more preferably from about 0 to about 0.6 wt. %, with a total 2-ring or larger aromatic species content less than 1 wt. %, more preferably less than 0.1 wt. %, more preferably less than or equal to about 0.01 wt. % based upon the total weight of the hydrogenated cycle oil.

The hydrogenated cycle oil passes to the second FCC riser reactor for injection and further cracking by contacting it catalytic cracking catalyst as described below for the second catalytic cracking stage. Hydrogenated cycle oil cracking in the second FCC reactor results in cracked products having substantial concentrations of naphtha and light olefins ($C_2$–$C_4$). Appropriate cracking conditions in the second FCC reaction stage include: (i) temperatures from about 495° C. to about 700° C., preferably from about 525° C. to 650° C.; (ii) hydrocarbon partial pressures from about 10 to 40 psia (70–280 kPa), preferably from about 20 to 35 psia (140–245 kPa); and, (iii) a catalyst to hydrogenated cycle oil (wt/wt) ratio from about 2:1 to 100:1, preferably from about 4:1 to 50:1 where the catalyst weight is the total weight of the catalyst mixture or catalyst composite. Steam may be concurrently introduced with the hydrogenated cycle oil into the second FCC reaction zone. The steam comprises up to about 50 wt. % of the hydrogenated cycle oil feed. Preferably, the cycle oil residence time in the second FCC reaction zone is less than about 20 seconds, more preferably between about 1 to 10 seconds.

The catalyst of the second catalytic cracking stage comprises a shape-selective zeolite and a large-pore zeolite, preferably on separate matrix materials so that the catalyst of the second catalytic cracking stage is a mixture of shape-selective zeolite on a matrix material and large-pore zeolite on a matrix material. In one embodiment, the catalyst of the second catalytic cracking stage comprises between about 50 and about 95 wt. %, more preferably between about 80 and about 95 wt. %, more preferably about 90 wt. % of a catalyst containing a shape-selective zeolite, preferably ZSM-5, present in an amount preferably ranging from about 10 to about 50 wt %, more preferably about 20 to about 30 wt % based on the total weight of the catalyst containing the shape-selective zeolite. The remainder of the catalyst of the second catalytic cracking stage contains a large-pore zeolite having a pore diameter greater than 0.7 nm. The catalyst of the second catalytic cracking stage preferably comprises a matrix material having a surface area greater than 40 $m^2/g$.

In some embodiments, it may be desirable to incorporate both the large-pore zeolite and shape-selective zeolite onto the same matrix material. In such an embodiment, the matrix material preferably comprises 50% or less by weight of the total weight of the catalyst. In these embodiments, the shape-selective zeolite and large-pore zeolite comprise between about 10 and about 80 wt. % of the total weight of the catalyst and the weight ratio of shape-selective zeolite to large-pore zeolite is between about 1:1 and about 100:1, more preferably between about 2:1 and about 90:1, still more preferably between about 3:1 and about 90:1.

Preferred large-pore zeolites for the catalyst of the second catalytic cracking stage include zeolites iso-structural to zeolite Y. These include the ion-exchanged forms such as the rare-earth hydrogen and ultra stable (USY) form. Preferably, the large-pore zeolite is zeolite Y having a unit cell size less than or equal to about 24.33 Å, more preferably less than or equal to about 24.27 Å.

Preferred shape-selective zeolite species useful in the catalyst of the second catalytic cracking stage include medium-pore-size zeolites generally having a pore size from about 0.5 nm, to about 0.7 nm. Such zeolites include, for example, MFI, MFS, MEL, MTW, EUO, MTT, HEU, FER, and TON structure type zeolites (IUPAC Commission of Zeolite Nomenclature). Non-limiting examples of such medium-pore-size zeolites, include ZSM-5, ZSM-12, ZSM-22, ZSM-23, ZSM-34, ZSM-35, ZSM-38, ZSM-48, ZSM-50, silicalite, and silicalite 2. A preferred shape-selective zeolite ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference.

The particle diameter of the catalyst of the second catalytic cracking stage will range from about 10 to 300 microns, with an average particle diameter of about 60 microns.

Light olefins resulting from the preferred process may be used as feeds for processes such as oligimerization, polymerization, co-polymerization, ter-polymerization, and related processes (hereinafter "polymerization") to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

EXAMPLES

Example 1

In accordance with an embodiment of this invention, cycle oil obtained from a cycle oil stream produced by a primary FCC reactor was hydroprocessed and further cracked in a second FCC riser reactor. Catalytic cracking conditions in the second FCC riser reactor include temperatures ranging from about 1000–1350° F. (535–760° C.), catalyst/cycle oil ratios of 25–150 (wt/wt), and vapor residence times of 0.1–1.0 seconds in the pre-injection zone.

First, two cycle oil samples were hydrogenated to produce a significant amount of tetrahydronaphthalenes (Table 1, column 1) or under different hydrogenation conditions to produce significant amounts of decahydronaphthalenes (Table 1, column 2) prior to upstream injection into the second FCC reactor. As set forth in Table 1, the hydrogenation conditions to form decahydronaphthalenes result in nearly complete saturation of aromatic species present in the cycle oil.

TABLE 1

| | Hydrogenation to at least partially saturate aromatics (form Tetrahydronaphthalenes) | Hydrogenation to substantially saturate aromatics |
|---|---|---|
| Conditions | | |
| Catalyst | $NiMo/Al_2O_3$ | $Pt/Al_2O_3$ |
| Temperature (° F.)/(° C.) | 700/371 | 550/288 |
| Pressure (psig) | 1200 | 1800 |
| LHSV | 0.7 | 1.7 |
| $H_2$ Treat Gas Rate (SCF/B) | 5500 | 5000 |
| Product Properties | | |
| Boiling Point Distribution | | |
| 0.5 wt. % (° F.)/(° C.) | 224.6/107.0 | 219.7/104.3 |
| 50.0 wt. % (° F.)/(° C.) | 513.4/267.4 | 475.5/246.4 |
| 99.5 wt. % (° F.)/(° C.) | 720.4/382.4 | 725.4/385.2 |
| Gravity (°API) | 26.2 | 33.2 |
| Total Aromatics (wt. %) | 57.6 | 0.6 |
| One-Ring Aromatics (wt. %) | 43.1 | 0.6 |
| Feedstock Properties | | |
| Boiling Point Distribution | | |
| 0.5 wt. % (° F.)/(° C.) | 299.8/148.8 | 224.6/107.0 |
| 50.0 wt. % (° F.)/(° C.) | 564.9/296.1 | 513.4/267.4 |
| 99.5 wt. % (° F.)/(° C.) | 727.8/386.6 | 720.4/382.4 |
| Gravity (°API) | 13.8 | 26.2 |
| Total Aromatics (wt. %) | 83.5 | 57.6 |
| One-Ring Aromatics (wt. %) | 9.7 | 43.1 |

Second, a Microactivity Test Unit ("MAT") was used to test the effect of added ZSM-5 cracking catalyst on propylene production in the second riser reactor. MAT tests and associated hardware are described in *Oil and Gas* 64, 7, 84, 85, 1966, and *Oil and Gas,* Nov. 22, 1971, 60–68. Conditions used included temperature 550° C., run time 1.5 sec., catalyst charge 4.0 g, feed volume 0.95–1.0 $cm^3$, and cat/oil ratio 4.0–4.2. The base catalyst employed was a conventional FCC catalyst containing zeolite Y. The results illustrated in FIG. 1 and Table 2 show that adding a catalyst containing ZSM-5 improves propylene yield provided the amount of the ZSM-5-containing catalyst remains below about 95 wt. %. In this and in the following examples, product wt. % is based on the weight of the feed to the reactor, and catalyst wt. % is based upon the total weight of the catalyst charge.

TABLE 2

| OPTIMUM ZSM-5 CATALYST FOR HYDROPROCESSED CYCLE OIL | | | | | |
|---|---|---|---|---|---|
| Feedstock | Saturated LCCO | ← | | → | |
| Catalyst(s) (Steamed) | 100% Base Catalyst | 40% Base Catalyst 60% ZSM-5 Catalyst | 20% Base Catalyst 80% ZSM-5 Catalyst | 10% Base Catalyst 90% ZSM-5 Catalyst | 100% ZSM-5 Catalyst |
| Temperature | 1020° F. (549° C.) | ← | | → | |
| Cat/Oil | 4.15 | 4.00 | 4.07 | 4.00 | 4.00 |
| Conversion 430° F. (221° C.) | 93.3 | 90.0 | 87.0 | 86.5 | 49.1 |
| Yields, wt.% FF | | | | | |
| C2-Dry Gas | 3.3 | 4.5 | 6.0 | 6.4 | 3.3 |
| Propylene | 7.1 | 12.4 | 14.1 | 14.3 | 6.2 |
| Propane | 2.3 | 2.4 | 3.2 | 3.2 | 0.7 |
| Butenes | 4.5 | 7.9 | 8.9 | 9.1 | 4.0 |
| Butanes | 13.2 | 11.2 | 10.8 | 8.3 | 0.8 |
| Naphtha | 59.8 | 49.9 | 42.1 | 43.9 | 33.4 |
| 430° F.+ (211° C.+) | 6.7 | 10.0 | 13.0 | 13.5 | 50.8 |
| Coke | 3.1 | 1.7 | 1.9 | 1.3 | 0.8 |
| Ethylene | 1.4 | 3.8 | 5.1 | 5.6 | 2.4 |

Example 2

In accordance with another embodiment, this example describes the effect of zeolite unit cell size on olefin production in the second riser reactor. As in example 1, a cycle oil was hydroprocessed to form a significant amount of decahydronaphthalenes and a MAT unit was used to simulate conditions in the second riser reactor. MAT Conditions used included temperature 1020° F. (~550° C.), run time 15 sec., catalyst charge 4.0 g, feed volume 0.95–1.0 $cm^3$, and cat/oil ratio 3.7 to 12.

In Table 3, catalyst A contains zeolite Y with a unit cell size (UCS) of about 24.30 Å, a zeolite surface area of 152 $m^2/g$ and a matrix surface area of 103 $m^2/g$. Catalyst B contains ZSM-5 (about 40 wt % based on the total weight of Catalyst B). Catalyst C contains zeolite Y having a unit cell size of about 24.32 Å, a zeolite surface area of about 139 $m^2/g$ and a matrix surface area of about 111 $m^2/g$. Catalyst D contains zeolite Y having a unit cell size of about 24.27 Å, a zeolite surface area of about 129 $m^2/g$ and a matrix surface area of about 104 $m^2/g$. Catalyst E is an amorphous FCC catalyst containing no zeolite and having a high surface area of about 92 $m^2/g$.

TABLE 3

| OPTIMUM BASE CATALYST + ZSM-5 FOR HYDROPROCESSED CYCLE OIL | | | | | |
|---|---|---|---|---|---|
| Feedstock | Saturated LCCO | ← | | → | |
| Catalyst(s) (Steamed) | 20% Catalyst A (UCS 24.30Å) 80% Catalyst B | 25% Catalyst C (UCS 24.32Å) 75% Catalyst B | 25% Catalyst D (UCS 24.27Å) 75% Catalyst B | 10% Catalyst D (UCS 24.27A) 40% Catalyst E 50% Catalyst B | 40% Catalyst A (UCS 24.30Å) 60% Catalyst B |
| Temperature, ° F. | 1020 | ← | | → | |
| Cat/Oil | 4.6 | 3.7 | 5.2 | 12 | 4.0 |
| Conversion, 290° F. | 70 wt.% | ← | → | | |
| Yields, wt.% FF | | | | | |
| C2-Dry Gas | 6.8 | 4.0 | 6.3 | 9.0 | 4.5 |
| Propylene | 14.3 | 12.0 | 15.8 | 14.9 | 12.4 |
| Propane | 3.8 | 2.2 | 2.8 | 3.7 | 2.4 |
| Butenes | 8.5 | 8.0 | 10.2 | 8.4 | 7.9 |
| Butanes | 12.3 | 10.1 | 8.0 | 8.9 | 11.2 |
| Naphtha | 22.4 | 31.9 | 25.2 | 22.6 | 29.9 |
| 290° F.+ | 30.0 | 30.0 | 30.0 | 30.0 | 30.0 |
| Coke | 1.9 | 1.8 | 1.7 | 2.5 | 1.7 |
| Ethylene | 5.8 | 3.2 | 5.4 | 7.6 | 3.8 |
| C4=/Sats | 0.69 | 0.79 | 1.28 | 0.94 | 0.71 |
| Total Lt Olefins | 28.6 | 23.2 | 31.4 | 30.9 | 24.1 |

Figure 2:
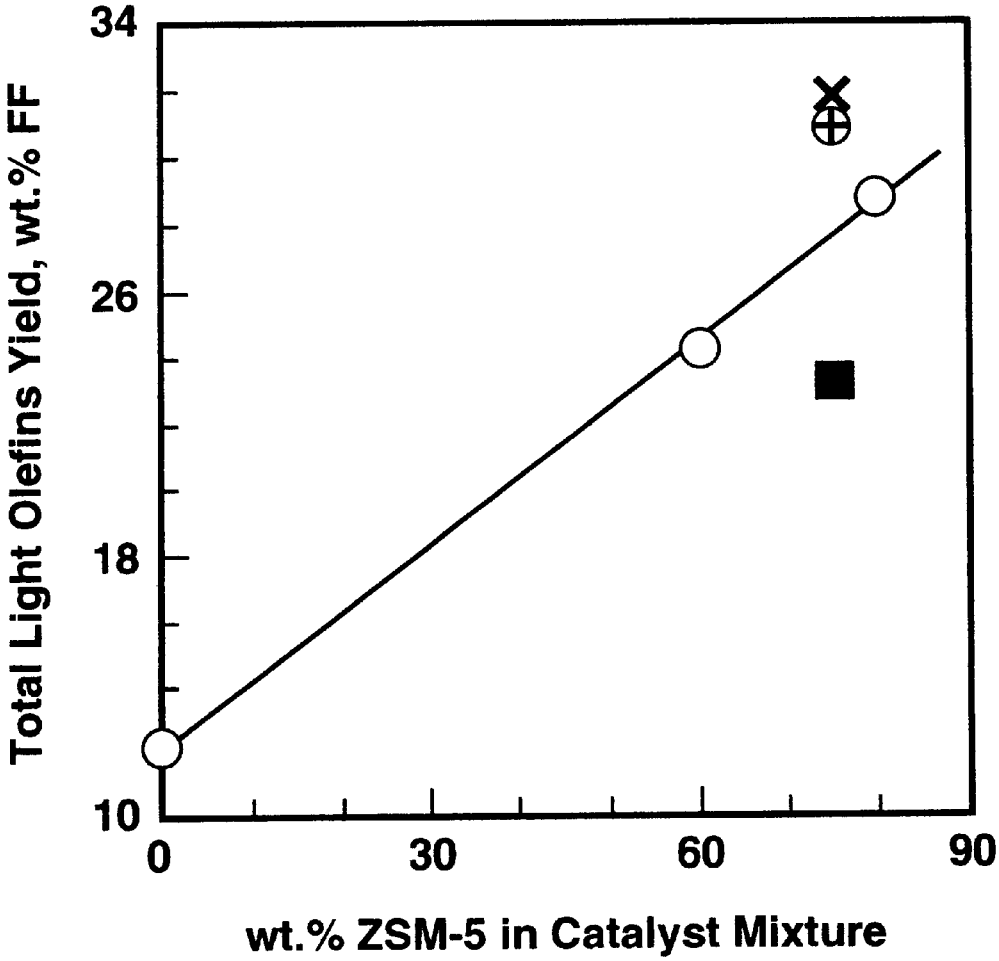
FIG. 2 illustrates the variation of total light olefin yield relative to the weight percentage of an additive catalyst containing ZSM-5.
Figure 3:
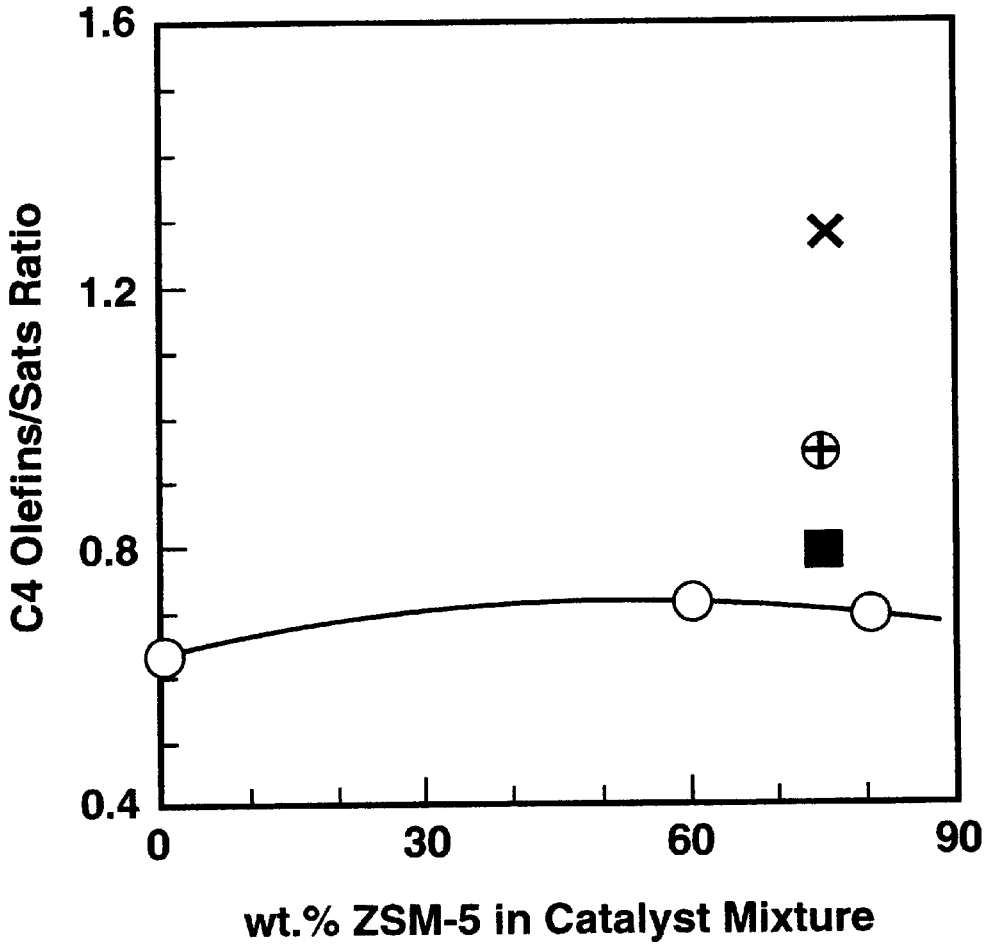
FIG. 3 illustrates the variation of $C_4$ olefin yield to total saturates ($C_4$ olefins/sats ratio) yield relative to the weight percentage of an additive catalyst containing ZSM-5.

In FIGS. 2 and 3, circular points are for the catalyst mixture of Table 3, columns 1 and 5 as well as the 100% base catalyst B with no ZSM-5 catalyst, square points are for the catalyst mixture of column 2, crosses are for the catalyst mixture of column 3, and x-circle are for the catalyst mixture of column 4.

As shown in Table 3, the highest yields of total light olefins, ethylene, propylene, and butenes were produced with catalyst mixtures containing the lower unit cell size, large-pore cracking catalyst C. This benefit was observed with a catalyst mixture containing 25% catalyst B plus 75% ZSM-5 additive and with a mixture containing only 10% large-pore cracking catalyst C and 40% of an amorphous cracking catalyst containing no zeolite.

FIG. 2 illustrates that for a substantially constant wt. % ZSM-5, a decrease in the unit cell size of the zeolite Y increases the total light olefins yield. FIG. 3 illustrates that for a substantially constant wt. % ZSM-5, a decrease in the unit cell size of the zeolite Y increases the ratio of $C_4$ olefins yield to saturated $C_4$ product yield.

What is claimed is:

1. A fluid catalytic cracking process comprising:

(a) contacting a FCC feed with a catalytic cracking catalyst in a first catalytic cracking stage under catalytic cracking conditions to produce cracked products wherein said catalytic cracking catalyst is a large pore zeolite having a pore diameter greater than about 0.7 nm;

(b) separating at least a cycle oil fraction from the cracked products, said cycle oil fraction comprising aromatics;

(c) hydrogenating at least a fraction of said aromatics in at least a portion of said cycle oil fraction in the presence of a hydrogenating catalyst under hydrogenation conditions to form a hydrogenated cycle oil; and, (d) contacting said hydrogenated cycle oil with a catalytic cracking catalyst under catalytic cracking conditions in a second fluid catalytic cracking stage to form a second cracked product, said second fluid catalytic cracking stage being separate from said first second fluid catalytic cracking stage, wherein the catalyst of the second fluid catalytic cracking stage comprises between about 50 and about 95 wt. % of a catalyst containing a shape-selective zeolite having a pore diameter less than about 0.7 nm, and between about 5 and about 50 wt. % of a catalyst containing a large-pore zeolite having a pore diameter greater than or equal to about 0.7 nm.

2. The process according to claim 1 wherein said hydrogenated cycle oil comprises less than about 5 wt. % aromatics.

3. The process according to claim 1 wherein the hydrogenated cycle oil comprises less than about 1 wt. % 2-ring or larger aromatic species.

4. The process according to claim 2 wherein said shape-selective zeolite is ZSM-5.

5. The process according to claim 4 wherein said large-pore zeolite is zeolite Y.

6. The process according to claim 5 wherein said zeolite Y has a unit cell size less than or equal to about 24.33 Å.

7. The process according to claim 6 wherein said zeolite Y has a unit cell size of less than or equal to about 24.27 Å.

8. The process according to claim 7 wherein the catalyst of the second catalytic cracking stage comprises between about 80 and about 95 wt. % of a catalyst containing ZSM-5.

9. The process according to claim 7 wherein the catalyst of the second catalytic cracking stage comprises about 90 wt. % of a catalyst containing ZSM-5.

10. The process according to claim 1 wherein the temperature within the first catalytic cracking stage is between about 500° C. and about 650° C.

11. The process according to claim 10 wherein the residence time within the first catalytic cracking stage is between about 1 and about 10 seconds.

12. The process according to claim 11 wherein the temperature within the second catalytic cracking stage is between about 495° C. and about 700° C.

13. The process according to claim 12 wherein the residence time within the second catalytic cracking stage is between about 1 and about 10 seconds.

14. The process according to claim 1 further comprising the step of separating propylene from the second cracked product and polymerizing the propylene to form polypropylene.

15. The process according to claim 1 wherein said hydrogenating catalyst comprises at least one Group VIII metal and at least one Group VI metal on at least one refractory support.

16. The process according to claim 15 wherein said Group VIII metal is selected from the group consisting of Pt, Pd, and Ir.

17. A process for catalytically cracking a cycle oil to selectively increase the yield of light olefins comprising the steps of:

(a) contacting a FCC feed with a catalytic cracking catalyst under catalytic cracking conditions in a first FCC reactor to form a first cracked product, said cracked product comprising a cycle oil fraction comprising aromatic species, wherein said catalytic cracking catalyst is a large pore zeolite having a pore diameter greater than about 0.7 nm;

(b) separating said first cracked product from the catalyst of the first FCC reactor;

(c) stripping the catalyst of the first FCC reactor;

(d) contacting the catalyst of the first FCC reactor with a gas comprising oxygen;

(e) passing the catalyst of the first FCC reactor back to said first FCC reactor;

(f) separating at least a portion of the cycle oil fraction from said first cracked product;

(g) hydrogenating a substantial portion of the aromatic species in at least a portion of said cycle oil fraction in the presence of a hydrogenation catalyst under hydroprocessing conditions to form a substantially hydrogenated cycle oil, said hydrogenation catalyst comprising at least one Group VIII metal and at least one Group VI metal on at least one refractory support, said Group VIII metal selected from the group consisting of Pt and Pd, wherein the weight of the aromatic species in the hydrogenated cycle oil is less than about 5% of the total weight of said hydrogenated cycle oil; and, (h) contacting said hydrogenated cycle oil with a catalytic cracking catalyst under catalytic cracking conditions in a separate second FCC reactor to form a second cracked product, wherein the catalyst used in the second FCC reactor comprises between about 80 and about 95 wt. % of a catalyst containing ZSM-5, and between about 5 and about 20 wt. % of a catalyst containing large-pore zeolite having a pore diameter greater than or equal to about 0.7 nm and a unit cell size less than 24.27 Å;

(i) separating the second cracked product from the catalyst of the second FCC reactor;

(j) stripping the catalyst of the second FCC reactor;

(k) contacting the catalyst of the second FCC reactor with a gas comprising oxygen; and, (l) passing the catalyst of the second FCC reactor to said second FCC reactor back to the second FCC reactor.

18. The process according to claim 17 further comprising the step of separating propylene from the second cracked product and polymerizing the propylene to form polypropylene.

19. A fluid catalytic cracking process comprising:

(a) contacting a FCC feed with a catalytic cracking catalyst in a first catalytic cracking stage under catalytic cracking conditions to produce cracked products;

(b) separating at least a cycle oil fraction from the cracked products, said cycle oil fraction comprising aromatics;

(c) hydrogenating a substantial portion of said aromatics in at least a portion of said cycle oil fraction in the presence of a hydrogenating catalyst under hydrogenation conditions to form a substantially hydrogenated cycle oil; and, (d) contacting said hydrogenated cycle oil with a catalytic cracking catalyst under catalytic cracking conditions in a second fluid catalytic cracking stage to form a second cracked product, said second fluid catalytic cracking stage being separate from said first second fluid catalytic cracking stage, wherein the catalyst of the second fluid catalytic cracking stage comprises a shape-selective zeolite and a large-pore zeolite having a pore diameter greater than or equal to about 0.7 nm and a unit cell size less than about 24.27 Å on the same matrix material and wherein the shape-selective zeolite and large-pore zeolite comprise between about 10 and about 80 wt. % of the total weight of the catalyst and the weight ratio of shape-selective zeolite to large-pore zeolite is between about 1:1 and about 100:1, and wherein the matrix material has a surface area greater than 40 $m^2/g$.

20. The process according to claim 19 wherein the weight ratio of shape-selective zeolite to large-pore zeolite is between about 3:1 and about 90:1.

21. The process according to claim 19 wherein the shape-selective zeolite is ZSM-5.

* * * * *